United States Patent [19]

Kilburn

[11] 4,294,563

[45] Oct. 13, 1981

[54] THERMALLY INSULATED BULKHEAD FOR IN SITU OIL SHALE RETORT

[75] Inventor: James S. Kilburn, Grand Junction, Colo.

[73] Assignee: Occidental Oil Shale, Inc., Grand Junction, Colo.

[21] Appl. No.: 28,226

[22] Filed: Apr. 9, 1979

[51] Int. Cl.[3] ..... E21F 17/00

[52] U.S. Cl. ..... 405/132; 299/2

[58] Field of Search ..... 405/132, 144, 266; 299/12, 19, 2

[56] References Cited

U.S. PATENT DOCUMENTS

| | | | |
|---|---|---|---|
| 2,855,757 | 10/1958 | Meade | 299/19 X |
| 3,302,343 | 2/1967 | Bear | 405/132 X |
| 4,076,312 | 2/1978 | Cha et al. | 299/12 X |
| 4,133,580 | 1/1979 | French | 299/2 |

FOREIGN PATENT DOCUMENTS

| | | | |
|---|---|---|---|
| 57083 | 3/1946 | Netherlands | 405/132 |

*Primary Examiner*—David H. Corbin

*Attorney, Agent, or Firm*—Christie, Parker & Hale

[57] ABSTRACT

An insulated bulkhead seals an access drift adjacent a hot portion of a fragmented permeable mass of formation particles containing oil shale in an in situ oil shale retort. The bulkhead includes a steel plate for closing the cross-sectional area of the drift. The periphery of the bulkhead is anchored in concrete in a slot cut into the walls, roof and floor of the drift. A first layer of heat insulating material is applied to a face of the bulkhead plate adjacent the hot portion of the fragmented mass for reducing heat transfer to the bulkhead from the fragmented mass. A second layer of heat insulating material covers the walls, roof and floor of the drift adjacent the insulated face of the bulkhead plate to minimize thermal degradation of formation surrounding the periphery of the bulkhead.

37 Claims, 5 Drawing Figures

THERMALLY INSULATED BULKHEAD FOR IN SITU OIL SHALE RETORT

BACKGROUND

This invention relates to in situ recovery of shale oil, and more particularly to a thermally insulated bulkhead for sealing an access drift adjacent a hot portion of an in situ oil shale retort.

The presence of large deposits of oil shale in the Rocky Mountain region of the United States has given rise to extensive efforts to develop methods for recovering shale oil from kerogen in the oil shale deposits. It should be noted that the term "oil shale" as used in the industry is in fact a misnomer; it is neither shale, nor does it contain oil. It is a sedimentary formation comprising marlstone deposit with layers containing an organic polymer called "kerogen", which upon heating, decomposes to produce liquid and gaseous products. It is the formation containing kerogen that is called "oil shale" herein, and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact, inasmuch as the treated shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,595; 4,043,596; 4,043,597; and 4,043,598, which are incorporated herein by this reference. These patents describe in situ recovery of liquid and gaseous hydrocarbon materials from a subterranean formation containing oil shale, wherein such formation is fragmented to form a stationary, fragmented permeable body or mass of formation particles containing oil shale within the formation, referred to herein as an in situ oil shale retort.

Hot retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the fragmented mass and introducing an oxygen-supplying gaseous combustion zone feed into the fragmented mass to advance the combustion zone through the fragmented mass. In the combustion zone, oxygen in the combustion zone feed is depleted by reaction with hot carbonaceous materials to product heat, combustion gas, and combusted oil shale. By the continued introduction of the combustion zone feed into the fragmented mass, the combustion zone is advanced through the fragmented mass.

The combustion gas and the portion of the combustion zone feed that does not take part in the combustion process pass through the fragmented mass on the advancing side of the combustion zone. This heats the oil shale in a retorting zone to a temperature sufficient to produce kerogen decomposition, called "retorting", in the oil shale. The kerogen decomposes into gaseous and liquid products, including gaseous and liquid hydrocarbon products, and into a residual solid carbonaceous material.

The liquid hydrocarbon products, together with water produced in or added to the fragmented mass, are collected at the bottom of the fragmented mass. An off gas also is withdrawn from the bottom of the fragmented mass. The off gas contains combustion gas, including carbon dioxide generated in the combustion zone, gaseous products produced in the retorting zone, carbon dioxide from carbonate decomposition, and any gaseous combustion zone feed that does not take part in the combustion process. The products of retorting are referred to herein as liquid and gaseous products.

The off gas produced during retorting can contain carbon monoxide and sulfur compounds such as hydrogen sulfide. Hydrogen sulfide and carbon monoxide are extremely toxic gases. For this reason it is desirable to seal an access drift which is in fluid communication with the fragmented mass so that workers in adjacent underground workings are isolated from the off gas produced in the fragmented mass during retorting operations.

Retorting operations in the fragmented mass can generate hot combustion gases in an access drift adjacent a hot portion of the fragmented mass. The temperature of gases in such an access drift can be 1400° F. or higher. It is desirable to provide a gas seal in such an access drift which can withstand such high temperatures without structural failure at least during the active life of the retort.

SUMMARY OF THE INVENTION

This invention provides means for forming a heat insulated gas seal in an access drift in gas communication with a hot portion of a fragmented permeable mass of formation particles containing oil shale in an in situ oil shale retort. The gas seal is provided by a bulkhead placed across the access drift. The bulkhead has an inside surface which faces toward the hot portion of the fragmented mass. In one embodiment of the invention a layer of heat insulating material on the inside surface of the bulkhead reduces heat transfer to the bulkhead from the hot portion of the fragmented mass. The bulkhead insulation layer sufficiently insulates the bulkhead from heat present in the access drift during retorting operations to inhibit structural failure or weakening of the bulkhead.

In another embodiment of the invention, a layer of heat insulating material overlies an inside wall of the drift adjacent the inside surface of the bulkhead for reducing heat transfer from the hot portion of the fragmented mass to formation adjacent the periphery of the bulkhead. The drift wall insulation layer inhibits thermal degradation of formation adjacent the periphery of the bulkhead.

DRAWINGS

Features of specific embodiments of the best mode contemplated for carrying out the invention are illustrated in the drawings, in which.

Figure 1:
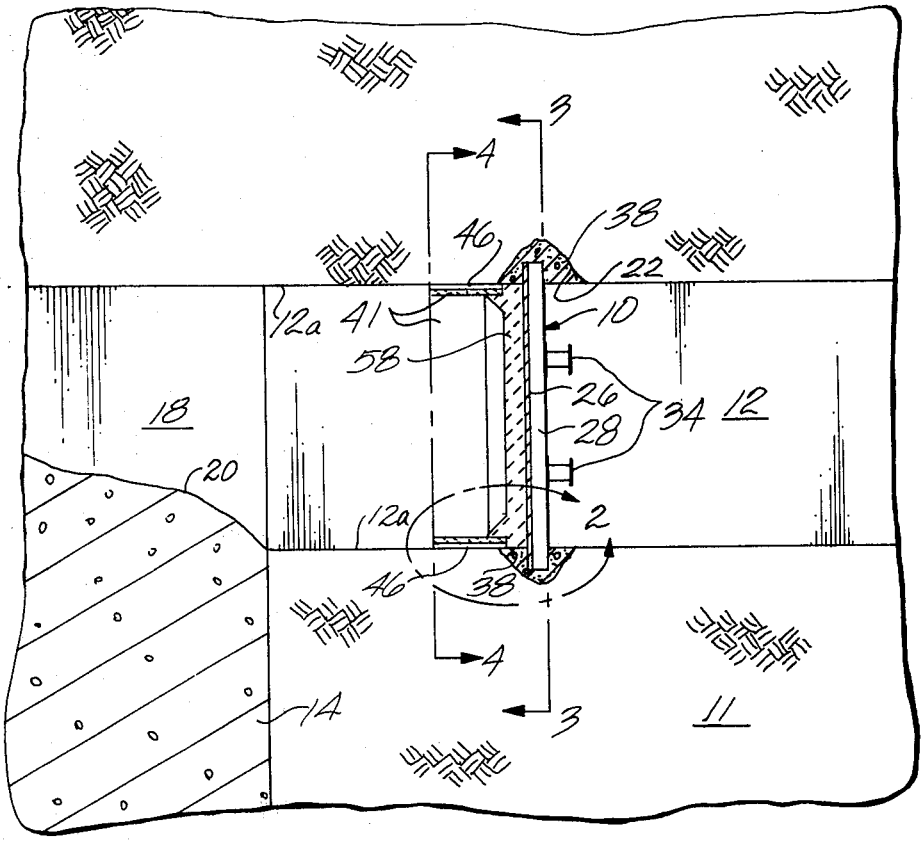
FIG. 1 is a fragmentary, semi-schematic cross-sectional side view showing an insulated bulkhead according to principles of this invention for sealing an access drift adjacent a fragmented permeable mass of formation particles containing oil shale in an in situ oil shale retort.
Figure 2:
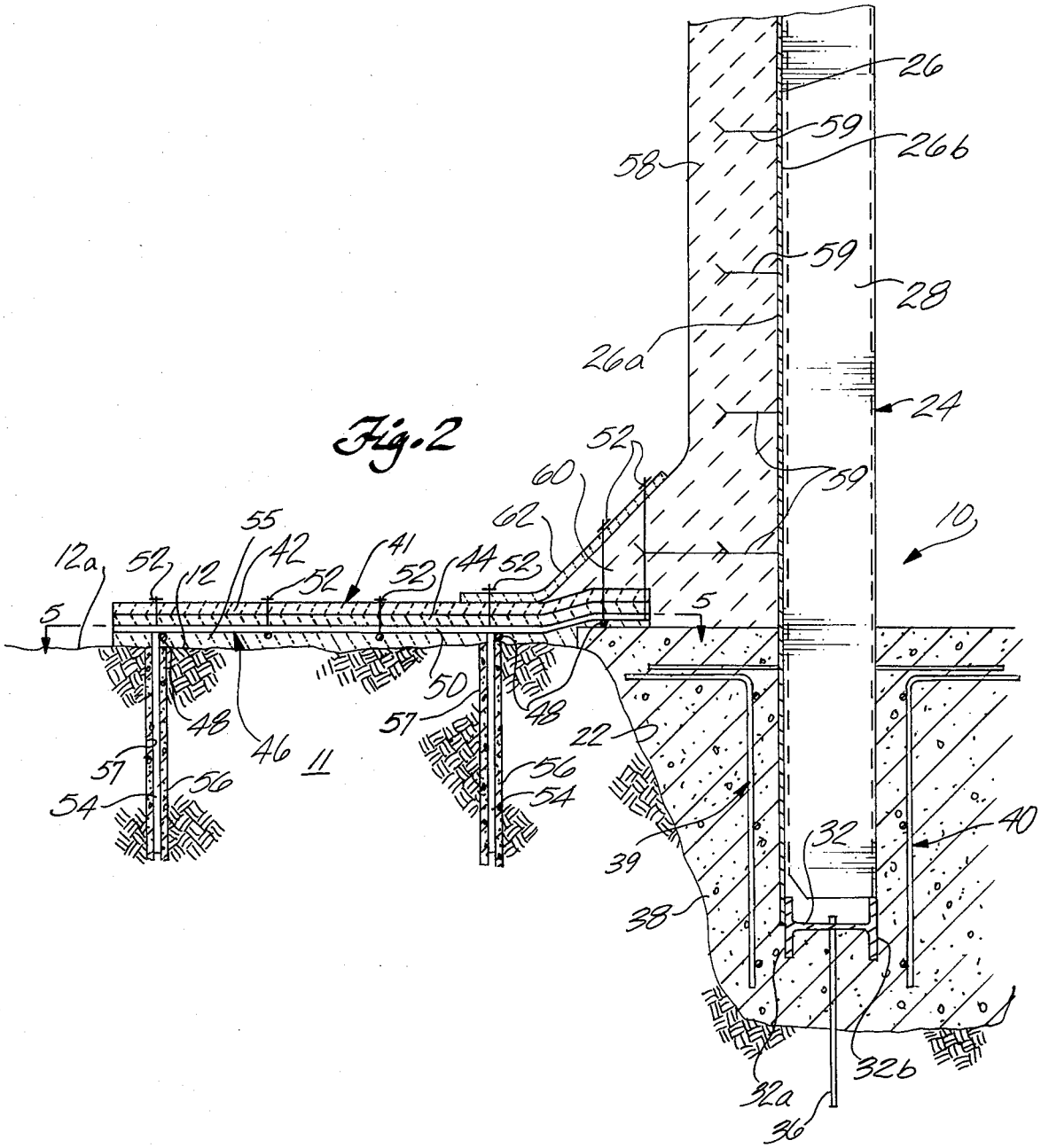
FIG. 2 is an enlarged fragmentary, cross-sectional side view of the means for anchoring and insulating the bulkhead within the line 2 of FIG. 1.
Figure 4:
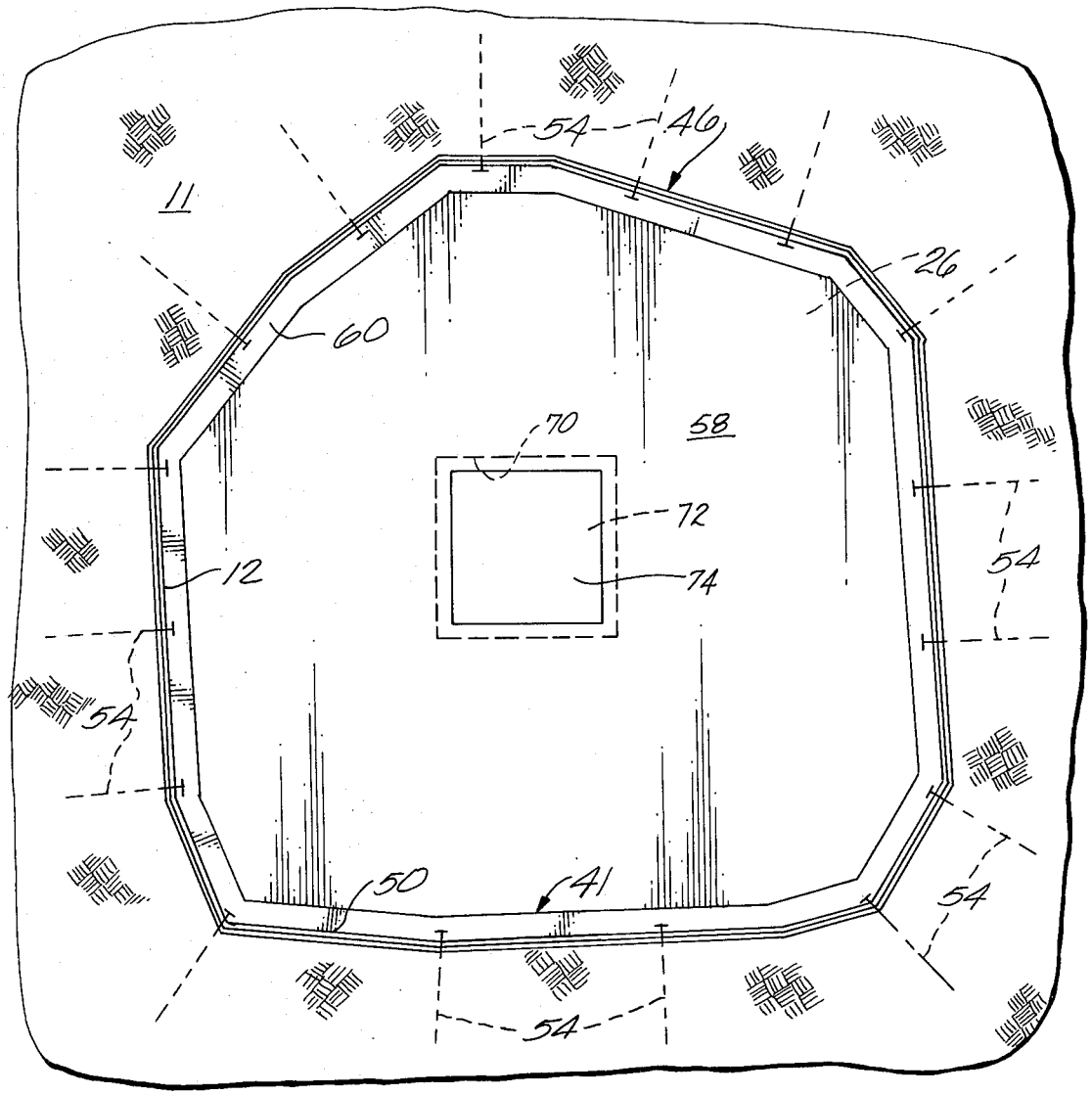
Figure 5:
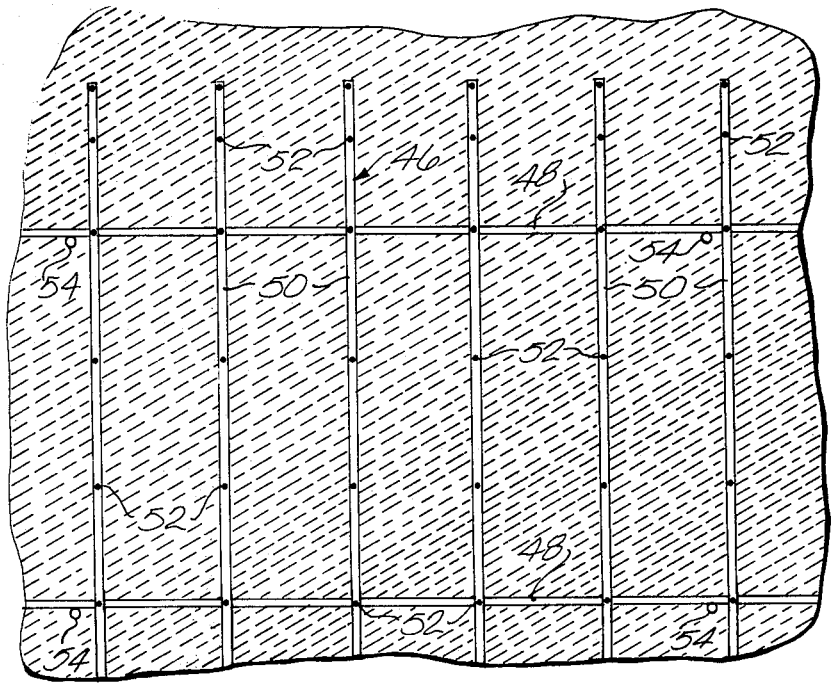

FIG. 4 is a fragmentary, cross-sectional front elevation view taken on line 4—4 of FIG. 1 and showing means for insulating the walls of the access drift surrounding the bulkhead and for anchoring such insulation to the drift wall; and FIG. 5 is a fragmentary top elevation view taken on line 5—5 of FIG. 2 at a time before insulation is added on the drift walls and showing a framework for anchoring the insulation to the walls of the access drift adjacent the bulkhead.

DETAILED DESCRIPTION

Referring to FIG. 1, a heat insulated bulkhead 10, constructed according to principles of this invention, is installed in a horizontal access drift 12 excavated in a subterranean formation 11 containing oil shale. The access drift 12 is excavated adjacent a fragmented permeable mass 14 of formation particles containing oil shale in an in situ oil shale retort formed in the formation 11 containing oil shale. The fragmented mass 14 is formed by excavating at least one void (not shown) from within the boundaries of the retort site, leaving a remaining portion of unfragmented formation within the retort site adjacent the void. Explosive placed in such remaining portion of unfragmented formation adjacent the void is detonated to explosively expand such remaining portion of unfragmented formation toward a free face of formation adjacent such a void to form the fragmented mass 14. Several suitable techniques are known as mentioned above.

The insulated bulkhead 10 seals the portion of the access drift 12 on the side of the bulkhead opposite the fragmented mass 14 from toxic gases produced in the fragmented mass 14 during retorting operations. Gas present in the portion of the access drift 12 between the fragmented mass 14 and the bulkhead 10 can have a temperature of about 1400° F. or more. The bulkhead and the drift walls adjacent the bulkhead are thermally insulated, according to principles of this invention, for inhibiting structural damage to the bulkhead and for inhibiting thermal degradation of formation adjacent the bulkhead from hot gases present in the access drift 12 adjacent the bulkhead during retorting operations.

Such a bulkhead can be at the top as in U.S. Pat. No. 4,027,917, or at the bottom as in U.S. Pat. No. 4,007,963, or in the middle as in U.S. Pat. No. 4,043,595 (FIG. 11) of an in situ oil shale retort. The illustrated embodiment happens to be at the top of a retort.

FIG. 1 illustrates one exemplary use of the heat insulated bulkhead 10 of this invention. In this example, the horizontal access drift 12 extends from a side boundary of a generally horizontal upper level void 18 which can extend above the top 20 of the fragmented mass 14 in the in situ retort. In this embodiment, access ports (not shown) formed in the bulkhead can provide access to the fragmented mass for a burner (not shown) and for fuel and air introduced into the top of the fragmented mass for initiating combustion in the fragmented mass. Access ports (not shown) also can be provided through the bulkhead for monitoring or analytical instrumentation (not shown) for measuring parameters, such as temperature and gas composition, at or near the top of the fragmented mass.

Figure 3:
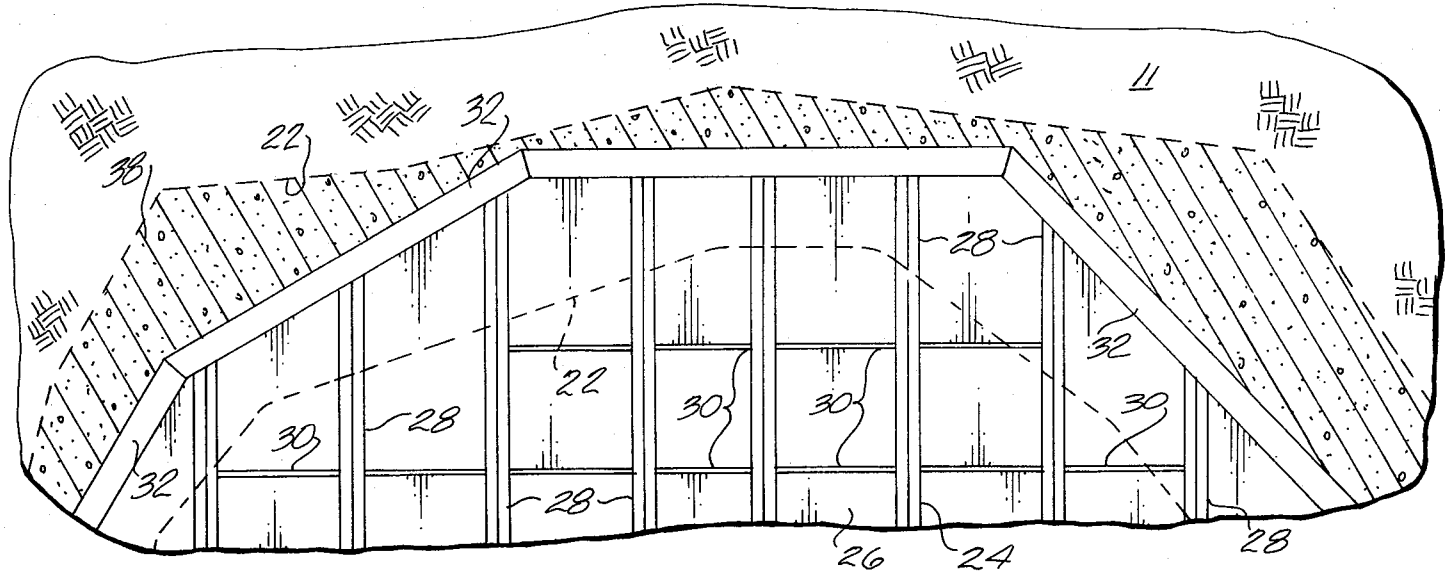
FIG. 3 is a fragmentary, rear elevation view taken on line 3—3 of FIG. 1 and showing the structure of the bulkhead framework.

Referring to FIGS. 1 through 3, the periphery of the bulkhead 10 is anchored in a peripheral slot 22 cut into the floor, roof and side walls of formation surrounding the access drift 12. The access drift is generally rectangular in cross-section and therefore defines a floor, roof and side walls which are referred to hereafter as the walls of the drift for simplicity. The peripheral slot 22 extends entirely around the wall of the drift 12, and the outer circumferential portion of the bulkhead extends outwardly into the slot beyond the drift wall.

The bulkhead structure comprises a rigid bulkhead framework 24 formed as a grid of structural steel members and a rigid planar bulkhead plate 26 welded to an edge of the bulkhead framework 24. In one embodiment the bulkhead plate 26 is a ⅜-inch thick steel plate which closes off the cross-sectional area of the access drift 12, except for access ports, manways and the like, (not shown) which can be provided in the bulkhead plate 26 for combustion air and fuel, for a burner for initiating combustion in the fragmented mass, and for desired instrumentation used on the inside of the bulkhead 10 adjacent the fragmented mass 14. The periphery of the bulkhead plate 26 is shaped generally as the cross-sectional contour of the drift wall, and the periphery of the bulkhead plate extends depthwise into the peripheral slot 22 formed in the walls of the drift. An inside face 26*a* of the bulkhead plate 26 faces toward the fragmented mass 14, and an outside face 26*b* of the bulkhead plate 26 faces toward the portion of the access drift on the side of the bulkhead opposite the fragmented mass.

The bulkhead framework 24 is initially installed in the peripheral slot, after which the bulkhead plate 26 is welded to an edge of the framework. In one embodiment, the bulkhead plate comprises separate vertically extending sections which are welded together along vertical seams to form an integral bulkhead plate.

The bulkhead framework 24 includes a series of vertically extending, parallel steel frame members 28 horizontally spaced apart across the width of the bulkhead plate 26. The frame members 28 are continuous for substantially the entire height or vertical dimension of the bulkhead plate, and therefore, the height of the respective frame members 28 can differ from one another in accordance with the cross-sectional contour of the drift wall. In the illustrated embodiment, each vertical frame member 28 comprises a pair of U-shaped channel members, the open portions of which face one another and are welded together along their adjoining edges to form an elongated rectangular box-beam.

The bulkhead framework 24 also includes a plurality of horizontally extending and vertically spaced apart steel stiffener plates 30 for providing lateral rigidity for intermediate portions of the vertical frame members 28. The stiffener plates 30 are preferably ⅜-inch thick and the opposite ends of each plate are welded to a respective pair of adjacent vertical frame members 28. The vertical frame members 28 and the horizontal support plates 30 can be welded to intermediate portions of the bulkhead plate 26 for added rigidity.

A peripheral frame extends around the periphery of the bulkhead framework 24. The peripheral frame is formed by a plurality of elongated structural steel support members 32 which are welded end-to-end for providing the equivalent of a rigid peripheral beam extending continuously around the periphery of the bulkhead framework 24. The peripheral frame matches the outer contour of the bulkhead plate 26. Each peripheral support member 32 is a steel wide-flange beam having an inside flange 32*a* (see FIG. 2) welded to the outside face 26*b* of the bulkhead plate at the periphery of the bulkhead plate 26. Each peripheral support member 32 also includes an outside flange 32*b* (see FIG. 2) welded to the ends of corresponding vertical frame members 28 which contact the outside flange 32*b*.

A pair of vertically spaced apart and parallel box-shaped steel transverse beams 34 (illustrated schematically in FIG. 1) extend horizontally across the width of the bulkhead framework 24. The box-shaped beams 34 are welded to intermediate portions of the vertical frame members 28 for reinforcing the rigidity of the bulkhead framework in a direction perpendicular to the face of the bulkhead framework. The transverse beams 34 also provide means for supporting a burner insert frame (not shown) secured to the outside of the bulkhead plate and surrounding an insulated burner access port 70 (see FIG. 4) in the bulkhead plate. The burner inset frame can include a rectangular tubular frame adjacent the burner access port for receiving a corresponding rectangular insert frame of the burner, and a burner adapter flange on an end of the tubular frame spaced from the access port for mating with a corresponding adapted flange on the burner.

FIG. 2 illustrates the means for anchoring the peripheral portion of the bulkhead in the peripheral slot 22 formed in the walls of the drift. The peripheral portion of the bulkhead plate 26 extends depthwise into the peripheral slot. The peripheral support members 32 of the bulkhead frame members 28 are in the slot. A plurality of circumferentially spaced apart rock anchors or rock bits 36 anchor the peripheral portion of the bulkhead framework to unfragmented formation 18 adjacent the base of the peripheral slot 22. In one embodiment the anchors 36 are steel rebar rock bolts which are mutually spaced apart on 3-foot centers around the entire periphery of the bulkhead. The inner portions of the anchors extend through corresponding holes in the central webs of the wide-flange beam peripheral support members and are welded thereto. The outer portions of the anchors 36 extend radially outwardly from the periphery of the bulkhead framework, parallel to the plane of the bulkhead plate 26, and are embedded with grout in holes drilled in unfragmented formation adjacent the peripheral slot 22.

Concrete 38 is cast in the slot 22 around the entire periphery of the bulkhead to secure the outer portion of the bulkhead plate 26 and the bulkhead framework 24 in the slot. The concrete is reinforced by carbon steel reinforcing grids embedded in the concrete around the periphery of the bulkhead plate. A first reinforcing grid 39 comprises steel rebar members welded together to form a rigid structural frame for reinforcing the concrete adjacent the inside face 26*a* of the bulkhead plate. Similarly, a second reinforcing grid 40 is embedded in the concrete 38 around the periphery of the bulkhead on the side of the bulkhead plate opposite the first reinforcing grid 39. The second reinforcing grid comprises carbon steel rebar members welded together to form a rigid structural frame for reinforcing the concrete adjacent the periphery of the bulkhead frame 24.

After the bulkhead 10 is anchored across the access drift 12, layers of thermal insulation are applied to the inside face 26*a* of the bulkhead plate 26 and to the drift walls surrounding the periphery of the bulkhead on the side of the bulkhead adjacent the fragmented mass. Such insulated drift walls are referred to herein as inside walls 12*a* of the drift. The layer of thermal insulation 58 applied to the inside face 26*a* of the bulkhead plate inhibits weakening or structural failure of the bulkhead plate and its supporting framework from heat present in drift during retorting operations in the fragmented mass. By maintaining the bulkhead structurally sound during retorting, leakage of gas to the portion of the access drift on the side of the bulkhead opposite the fragmented mass 14 is inhibited.

The layer of thermal insulation 41 applied to the inside walls 12*a* of the drift inhibits thermal degradation or undercutting of formation surrounding the periphery of the bulkhead. The temperature present in access drift 12 between the fragmented mass and the bulkhead can be in the order of 1400° F. or higher, during ignition or retorting. Retorting of kerogen and decomposition of mineral carbonates can occur in formation containing oil shale which is exposed to such temperatures. Such retorting and decomposition can occur to the extent that structural integrity of the formation can be significantly degraded and thermal sloughing of parts of the walls can occur. By insulating the inside walls of the drift from such heat, the peripheral support for the bulkhead provided by the walls of formation surrounding the bulkhead is maintained intact during retorting. Absent such insulation on the walls leakage around the bulkhead or structural damage could occur.

The thermal insulation applied to the inside walls 12*a* of the drift comprises a layer 41 of heat insulating material placed over the floor, roof and side walls of the drift adjacent the inside face 26*a* of the bulkhead plate. The drift wall insulating layer 41 comprises a sufficient thickness of a material having a sufficiently low thermal conductivity that it can insulate formation adjacent the inside walls of the drift from heat to the extent that thermal degradation of formation adjacent the periphery of the bulkhead is inhibited for at least as long as high temperatures are present in the drift during retorting operations.

In one embodiment, the drift wall insulating layer 41 comprises a composite heat insulating layer which includes an outer layer of sprayed refractory insulation 55 and overlying top and bottom layers 42 and 44, respectively, of glass fiber batting. Each layer of batting can be about one-inch thick, and in one embodiment, the composite heat insulating layer 41 extends from near the inside face 26*a* of the bulkhead plate 26 approximately five feet along the drift walls toward the fragmented mass, forming a generally tubular-shaped insulating layer overlying the correspondingly-shaped walls of unfragmented formation surrounding the periphery of the bulkhead plate.

The layers 42 and 44 of fiber glass batting are secured in place over the drift walls by a steel support grid 46 formed as a rigid framework and anchored to the drift walls adjacent the inside face 26*a* of the bulkhead plate. The insulation support grid 46 is a high alloy stainless steel framework which is continuous around the portion of the drift walls surrounding the periphery of the bulkhead plate. As shown in FIG. 4, the grid 46 is contoured to match the contour of the drift wall. As shown in FIGS. 2 and 5, the insulation support grid 46 includes a series of mutually spaced apart and parallel longitudinal bars 50 extending perpendicularly to the plane of the bulkhead plate 26, and a series of mutually spaced apart and parallel lateral bars 48 which intersect and are welded to the longitudinal bars 50 to form a rectangular grid framework. In one embodiment, the bars 50 can be spaced approximately 10 inches apart from one another. A stainless steel reinforcing bar makes a suitable framework for supporting the insulation because of its high temperature resistance. A desirable material is ½-inch round A.I.S.I. type 310 solid stainless steel bar, which is a high alloy with chromium and nickel. A plurality of high alloy insulation anchor studs 52 are welded to each longitudinal bar 50 at locations spaced along the length of each longitudinal bar and extend inwardly in the drift. The anchor studs also can be type 310 stainless steel.

Prior to securing the layers 42 and 44 of fiber glass batting to the insulation support grid 46, the grid is anchored to the drift walls adjacent the bulkhead. The insulation support grid is formed by welding high alloy stainless steel bars together to form a generally tubular frame shaped to match the cross-sectional contour of the drift wall surrounding the periphery of the bulkhead. The insulation support grid is anchored adjacent the inside face 26*a* of the bulkhead plate by welding the lateral bars 48 to high alloy rods which are mutually spaced apart around the drift wall adjacent the bulkhead. These rods are used as rock anchor bolts and are anchored in expansion grout 56 cast in holes 57 drilled into the walls of the drift. The rock anchor bolts can have carbon steel washers 52 welded to their ends for inhibiting pull out from the wall of the drift. These anchors can be type 310 stainless steel. In one embodiment, the rock anchor bolts can be spaced approximately 8 feet apart across the floor of the drift and approximately 4 feet apart along the side walls and across the roof of the drift.

After the insulation support grid 46 is anchored to the drift wall adjacent the bulkhead plate, the layer 55 of heat insulating material is applied to the formation walls over the grid to inhibit transfer of heat into the space between the fiber glass batting and the drift wall. The heat insulation layer 55 can be applied in a thickness which covers and protects the support grid members and fills the space between the grid and the adjacent drift wall continuously around the entire drift wall. The insulation anchor studs 52 are left projecting away from the grid and the heat insulating layer 55. The heat insulating layer can be formed from a sprayable refractory material such as used to cover the inside face 26*a* of the bulkhead plate and which is described below.

After the heat insulating layer 55 is applied over the drift walls and the insulation support grid 46, the layers 42 and 44 of fiber glass batting are secured to the insulation support grid. The high alloy insulation anchor studs 52 project radially into the drift away from the drift wall to provide a matrix of anchors for securing the layers of fiber glass batting over the support grid members and the heat insulating layer 55. The insulation forms a substantially tubular layer adjacent the inside surface of the bulkhead. The anchor studs 52 extend through the fiber glass batting. A separate high alloy flat plate akin to a washer is secured to the exposed tip of each stud 52 so that the washer lies flat against the exposed face of the fiber glass batting. The washers are secured to the tips of the anchor studs by clips to form a matrix of T-shaped anchors. A sufficient number of these anchors is used to hold the batting in place around the drift wall.

After the composite drift wall insulating layer 41 is applied, the layer of thermal insulating material 58 is applied to the inside face 26*a* of the bulkhead plate 26. The bulkhead insulation layer 58 comprises a sufficient thickness of a material having a sufficiently low thermal conductivity that structural weakening or failure of the bulkhead plate and its supporting framework is inhibited to the extent that leakage through the bulkhead is substantially prevented throughout retorting operations. The bulkhead insulation 58 covers the entire surface area of the bulkhead plate which is exposed to heat in the drift adjacent the fragmented mass. The bulkhead insulation can be a castable refractory material which can be applied to the face of the bulkhead plate by spraying or "guniting" techniques. The material can be sprayed on in layers and then cured in situ to form a semi-rigid heat insulating layer adhered to the face of the bulkhead plate 26. A matrix of mutually spaced apart heat resistant insulation anchors 59 are welded to and project perpendicularly away from the plane of the bulkhead plate toward the fragmented mass. The anchors 59 are embedded in the layer 58 of bulkhead insulation to aid in anchoring the insulation layer to the upright inside face of the bulkhead plate. Each heat resistant anchor 59 comprises a round, narrow metal stem welded to the inside face of the bulkhead plate and projecting perpendicularly from the face to the bulkhead. The tip of each stem has a thin, V-shaped metal rod welded to it. The V-shaped tip of each stem diverges away from the face of the bulkhead, and each leg of the V projects on an angle of about 135° with respect to the plane of the stem. The Y-shaped anchors 59 enable the refractory insulation 58 to expand under the heat to which it is exposed during use and still remain in place on the face of the bulkhead.

A peripheral portion 60 of the bulkhead insulation 58 is applied so as to overlap the innermost portion of the drift wall insulation 41 closest to the bulkhead plate 26. The peripheral portion 60 of the bulkhead insulation is applied in a greater thickness than the insulation on the rest of the bulkhead plate to assure a good continuous heat seal around the periphery of the bulkhead and protect the concrete in the slot 22 from thermal degradation.

During and after construction of the bulkhead and application of the insulation to the bulkhead, the burner the burner access port (not shown) can be used as a manway for workmen needing access to the portion of the drift 12 adjacent the fragmented mass. Following use of the burner to establish combustion in the fragmented mass, the burner access opening is closed by a cover 72 (see FIG. 4) having a gasket seal for completing the seal provided by the bulkhead. An inside face of the cover 72 can be covered with a layer 74 of the same castable refractory thermal insulation described above to provide an essentially continuous layer of insulation on the inside face of the bulkhead. The layer of insulation 74 on the cover 72 can have an area less than that of the burner access port 70 and the insulation 58 on the face of the bulkhead surrounding the access port can match the periphery of the insulation on the cover, as illustrated in FIG. 4. This avoids a direct path for heat flow through the insulation at the juncture between the insulation 58 on the bulkhead and the insulation 74 on the cover 72.

In one embodiment the castable refractory material comprises a heat insulating material identified as VSL-50 and sold by A. P. Green Refractories Co. Such insulating material comprises about 51 to 54% silica, about 32 to 35% alumina, about 9.5 to 11% calcium oxide, about 1 to 2% alkalies such as sodium oxide or potassium oxide, about 0.6 to 0.9% iron oxide, about 0.1 to 0.6% magnesia, and about 0.5 to 1.5% titanium dioxide. Such a sprayable refractory thermal insulating material has a thermal conductivity of about 1.74 BTU/sq.ft./hr./°F./inch at a mean temperature of 1600° F. The material has a temperature resistance of 2300° F., i.e., it does not melt or otherwise thermally degrade when a surface of the insulating material is exposed to temperatures up to about 2300° F.

A peripheral heat insulating layer 62 of fiber glass batting overlies the juncture between the peripheral portion 60 of the bulkhead insulation and the inside portion of the drift wall insulation 41 adjacent the bulkhead insulation layer 58. The peripheral heat insulating layer 62 covers this juncture entirely around the drift wall for forming a continuous heat seal to inhibit heat transfer from inside the drift through the juncture. The peripheral heat insulating layer 62 is secured in place by anchor studs 52 projecting from a portion of the insulation support framework 46.

The refractory thermal insulation layer 58 comprises a sufficient thickness of material having a sufficiently low thermal conductivity that it can reduce by approximately 90%, or more, the amount of heat transferred from the portion of the access drift adjacent the fragmented mass to the inside face **26*a* of the bulkhead plate during retorting operations. In one embodiment wherein the gas temperature in the drift adjacent the insulated face of the bulkhead can be about 1400° F. or more, an 8-inch thick bulkhead insulation layer 58 comprising the refractory thermal insulating material described above can provide a sufficient reduction in heat transfer that the skin temperature of the inside face 26*a* of the bulkhead can be maintained between about 120° F. to 150° F. during ignition and retorting operations. In this same embodiment, the skin temperature of the outside face 26*b* of the bulkhead can be about 100° F., and the air temperature in the drift adjacent the outside face of the bulkhead can be about 60° F. The outside face of the bulkhead plate is not insulated so that heat can be transferred away from the bulkhead into the portion of the drift opposite the fragmented mass 14** in the retort.

In the same embodiment wherein the gas temperature in the drift adjacent the insulated face of the bulkhead can be 1400° F. or more, the composite drift wall insulating layer 41 described above can reduce by approximately 90%, or more, the amount of heat transferred from the hot portion of the drift to the inside walls **12*a* of the drift through the drift wall insulation. This heat gradient is sufficient to inhibit thermal degradation of the drift walls surrounding the periphery of the bulkhead 10**.

The castable refractory thermal insulation material used for the bulkhead insulation and the fiber glass batting used for the drift wall insulation can comprise various other heat insulating materials, such as ceramic fibers, rock wool, glass wool, or asbestos, if desired, or even foam plastics in cooler regions. In any case, the desired bulkhead insulation has a sufficiently low thermal conductivity that it can reduce by approximately 90%, or more, the amount of heat transferred to the bulkhead plate from the portion of the drift exposed to temperatures likely to be encountered during igniting and retorting operations. The desired drift wall insulation has a sufficiently low thermal conductivity that thermal degradation of formation along the drift wall adjacent the bulkhead is inhibited when such insulation is exposed to temperatures likely to be encountered in the access drift during igniting and retorting operations. The desired insulation for the drift wall and the bulkhead plate also comprises a material which is resistant to temperatures substantially in excess of temperatures likely to be encountered in the access drift 12 adjacent the hot portion of the fragmented mass 14.

Thus, the present invention provides means for thermally insulating a bulkhead which forms a gas seal in an access drift adjacent a hot portion of a fragmented mass in an in situ oil shale retort. Thermal insulation on the face of the bulkhead adjacent the fragmented mass insulates the bulkhead from heat sufficiently to inhibit weakening or structural failure throughout the active life of the retort. Thermal insulation on the drift walls adjacent the insulated face of the bulkhead insulates the drift walls from heat sufficiently to inhibit thermal degradation or undercutting of formation in which the periphery of the bulkhead is anchored, which maintains the integrity of formation surrounding the bulkhead throughout the active life of the retort. Thus, the insulated bulkhead of this invention can provide a competent gas seal in the access drift throughout retorting operations.

What is claimed is:

1. An insulated heat seal in an access drift adjacent a portion of in situ oil shale retort comprising:

a bulkhead placed across an access drift excavated in formation containing oil shale, the drift being in communication with a fragmented permeable mass of formation particles containing oil shale in an in situ oil shale retort, the bulkhead having an inside surface facing toward the fragmented mass, the access drift having an inside wall between the inside surface of the bulkhead and the fragmented mass;

a first layer of heat insulating material on the inside surface of the bulkhead for reducing heat transfer to the bulkhead from a hot portion of the fragmented mass in communication with said access drift; and a second elongated layer of heat insulating material on the inside wall of the access drift on the same side of the bulkhead as the first layer of heat insulating material, the second layer of heat insulating material extending along the length of the inside wall of the drift away from the first layer of heat insulating material for reducing heat transfer from said hot portion of the fragmented mass to formation forming the drift wall adjacent the inside surface of the bulkhead.

2. Apparatus according to claim 1 wherein the first and second layers of heat insulating material are joined together adjacent the periphery of the bulkhead to form a continuous heat seal between the inside surface of the bulkhead and the inside wall of the access drift and extending essentially entirely around the periphery of the bulkhead.

3. Apparatus according to claim 2 wherein the second layer of heat insulating material forms a substantially tubular layer of insulation adjacent the inside surface of the bulkhead.

4. Apparatus according to claim 3 including a rigid insulation supporting frame, means for anchoring the supporting frame to the drift wall, and means for anchoring the second layer of heat insulating material to the supporting frame.

5. Apparatus according to claim 1 including a plurality of mutually spaced apart anchor means projecting from the inside surface of the bulkhead and embedded in the first layer of heat insulating material for holding such first layer of heat insulating material on the bulkhead while allowing thermal expansion of the heat insulating material in response to heat from the hot portion of the fragmented mass.

6. Apparatus according to claim 1 including means for anchoring the periphery of the bulkhead in formation surrounding the drift wall; and wherein the second layer of heat insulating material is applied over the anchor means for reducing heat transfer to the anchor means from the hot portion of the fragmented mass.

7. Apparatus according to claim 1 wherein the first layer of heat insulating material comprises a sufficient thickness of material having sufficiently low thermal conductivity to reduce by at least approximately 90% the heat transferred to the inside face of the bulkhead from the hot portion of the fragmented mass relative to the heat present adjacent a face of the first layer of heat insulating material which is exposed to the hot portion of the fragmented mass.

8. Apparatus according to claim 7 wherein the first layer of heat insulating material comprises a castable refractory thermal insulating material.

9. Apparatus according to claim 1 wherein the first layer of heat insulating material comprises a sufficient thickness of material having sufficiently low thermal conductivity to provide a heat gradient across the first layer of heat insulating material such that the maximum temperature of the inside surface of the bulkhead is approximately 150° F. when the gas temperature on the side of the first layer of heat insulating material exposed to heat in the access drift is about 1400° F.

10. Apparatus according to claim 1 wherein the first and second layers of heat insulating material comprise a sufficient thickness of material having a sufficiently low thermal conductivity that the bulkhead remains in place across the access drift and inhibits the passage of gas from the fragmented mass to the drift on the side of the bulkhead opposite the fragmented mass for at least the active life of the retort.

11. Apparatus according to claim 1 wherein the second layer of heat insulating material comprises sufficient thickness of material having sufficiently low thermal conductivity to inhibit thermal degradation of formation along the drift wall adjacent the bulkhead.

12. Apparatus according to claim 1 including a rigid supporting frame overlying the inside wall of the drift adjacent the inside surface of the bulkhead; means for anchoring the supporting frame to the drift wall; and means for anchoring the second layer of heat insulating material to the supporting frame.

13. Apparatus according to claim 1 wherein the second layer of heat insulating material comprises fiber glass batting.

14. An insulated heat seal in an access drift adjacent a portion of an in situ oil shale retort, comprising:

a bulkhead placed across an access drift excavated in formation containing oil shale, the drift being in communication with a fragmented permeable mass of formation particles containing oil shale in an in situ oil shale retort, the bulkhead having an inside surface facing toward the fragmented mass, the access drift having an inside wall between the inside surface of the bulkhead and the fragmented mass;

means for anchoring a periphery of the bulkhead in the wall of the drift for inhibiting flow of gas from the fragmented mass to the drift on the side of the bulkhead opposite the fragmented mass;

a first layer of heat insulating material secured to the inside surface of the bulkhead; and a second elongated layer of heat insulating material overlying the inside wall of the access drift on the same side of the bulkhead as the first layer of heat insulating material, the second layer of heat insulating material extending along the length of the inside wall of the drift away from the first layer of heat insulating material, the second layer of heat insulating material being joined with the first layer of heat insulating material around the periphery of the bulkhead and being of sufficient thickness of a material having a sufficiently low thermal conductivity such that thermal degradation of formation along the drift wall adjacent the periphery of the bulkhead is inhibited when heat from the fragmented mass is present in the drift adjacent the second layer of heat insulating material during retorting operations.

15. Apparatus according to claim 14 wherein the second layer of heat insulating material overlies at least a portion of the bulkhead anchoring means.

16. Apparatus according to claim 14 wherein the first and second layers of heat insulating material are joined together adjacent the periphery of the bulkhead to form a continuous heat seal between the inside surface of the bulkhead and the inside wall of the access drift.

17. Apparatus according to claim 14 wherein the second layer of heat insulating material forms a substantially tubular layer of insulation adjacent the inside surface of the bulkhead.

18. Apparatus according to claim 17 including a rigid supporting frame, means for anchoring the supporting frame to the drift wall, and means for anchoring the second layer of heat insulating material to the supporting frame.

19. In an in situ oil shale retort containing a fragmented permeable mass of formation particles containing oil shale, and an access drift excavated in a portion of formation in communication with a hot portion of the fragmented mass; means for sealing such an access drift and for thermally insulating the sealed drift, the sealing and insulating means including:

a bulkhead placed across the access drift;

means anchoring the periphery of the bulkhead in a wall of the access drift for inhibiting flow of gas from the fragmented mass to the drift on a side of the bulkhead opposite the fragmented mass;

a first layer of heat insulating material on an inside surface of the bulkhead facing toward the hot portion of the fragmented mass for thermally insulating the bulkhead from heat from the hot portion of the fragmented mass during retorting operations, the first layer of heat insulating material comprising a sufficient thickness of a material having a sufficiently low thermal conductivity to reduce by at least approximately 90% the amount of heat transferred to the bulkhead from the hot portion of the fragmented mass when compared with the heat present on the side of the first layer of heat insulating material exposed to the hot portion of the fragmented mass; and a second elongated layer of heat insulating material on the inside wall of the access drift on the same side of the bulkhead as the first layer of heat insulating material, the second layer of heat insulating material extending along the length of the inside wall of the drift away from the first layer of heat insulating material for reducing heat transfer from the hot portion of the fragmented mass to formation forming the drift wall adjacent the inside surface of the bulkhead.

20. The sealing and insulating means according to claim 19 wherein the first layer of heat insulating material comprises a castable refractory material.

21. The sealing and insulating means according to claim 19 in which the heat gradient across the first layer of heat insulating material is such that the maximum temperature on the inside surface of the bulkhead is approximately 150° F. when the gas temperature in the drift on the side of the bulkhead exposed to heat from the fragmented mass is about 1400° F.

22. The sealing and insulating means according to claim 21 wherein the first layer of insulating material comprises a castable thermal refractory material.

23. The sealing and insulating means according to claim 22 including a plurality of mutually spaced apart anchor means for holding such first layer of heat insulating material on the bulkhead while allowing thermal expansion of such heat insulating material in response to heat from the hot portion of the fragmented mass projecting from the inside surface of the bulkhead and embedded in the refractory material.

24. In an in situ oil shale retort containing a fragmented permeable mass of formation particles containing oil shale, and an access drift excavated in a portion of formation in communication with a hot portion of the fragmented mass; means for sealing such an access drift and for thermally insulating such an access drift, comprising:

a bulkhead placed across the access drift, the bulkhead having a heat insulated inside surface which faces toward the fragmented mass, the access drift having an inside wall extending from the heat insulated inside surface of the bulkhead toward the fragmented mass; and an elongated layer of heat insulating material overlying the inside wall of the access drift on the same side of the bulkhead as the heat insulated inside surface of the bulkhead, the layer of heat insulating material extending along the length of the inside wall of the drift away from the heat insulated inside surface of the bulkhead for thermally insulating the inside wall of the access drift adjacent the inside surface of the bulkhead from heat from the fragmented mass for inhibiting thermal degradation of formation shale adjacent the periphery of the bulkhead.

25. Thermal insulating means according to claim 24 wherein the elongated layer of heat insulating material overlying the inside wall of the access drift extends essentially entirely around the portion of the drift wall surrounding the periphery of the bulkhead and forms a substantially tubular layer of insulation adjacent the bulkhead.

26. Thermal insulating means according to claim 25 including a rigid supporting frame, means for anchoring the supporting frame to the drift wall, and means for anchoring the elongated layer of heat insulating material to the supporting frame.

27. Thermal insulating means according to claim 26 in which the elongated layer of heat insulating material comprises a fibrous batting.

28. Thermal insulating means according to claim 27 including a layer of castable refractory thermal insulation between the fibrous batting and the drift wall.

29. Thermal insulating means according to claim 24 wherein the elongated layer of heat insulating material comprises a sufficient thickness of a material having sufficiently low thermal conductivity to reduce by at least approximately 90% the amount of heat transferred to the drift wall from heat in the access drift when compared with the heat present adjacent the portion of the elongated layer of heat insulating material exposed to such heat in the access drift.

30. Thermal insulating means according to claim 24 including means forming a continuous heat seal between the inside face of the bulkhead and the inside wall of the access drift.

31. An insulated heat seal in an access drift adjacent a hot portion of a fragmented permeable mass of formation particles containing oil shale in an in situ oil shale retort, comprising:

a bulkhead placed across an access drift excavated in formation containing oil shale, the drift being in communication with the hot portion of the fragmented mass, the bulkhead having a heat insulated inside surface facing toward the hot portion of the fragmented mass, the access drift having an inside wall extending from the heat insulated inside surface of the bulkhead toward the hot portion of the fragmented mass; and an elongated layer of heat insulating material on the inside wall of the access drift on the same side of the bulkhead as the heat insulated inside surface of the bulkhead, the layer of heat insulating material extending along the length of the inside wall of the drift away from the heat insulated inside surface of the bulkhead for inhibiting thermal degradation of formation along the drift wall adjacent the inside surface of the bulkhead.

32. Apparatus according to claim 31 including means forming a continuous heat seal between the bulkhead and the inside wall of the drift.

33. A method for forming an insulated heat seal in an access drift adjacent a portion of an in situ oil shale retort, comprising the steps of:

placing a bulkhead across an access drift excavated in formation containing oil shale wherein the drift is in communication with a fragmented permeable mass of formation particles containing oil shale in an in situ oil shale retort, the bulkhead having an inside surface facing toward the fragmented mass and the access drift having an inside wall between the inside surface of the bulkhead and the fragmented mass;

placing a first layer of heat insulating material on the inside surface of the bulkhead;

placing a second elongated layer of heat insulating material on the inside wall of the access drift on the same side of the bulkhead as the first layer of heat insulating material, the second layer of heat insulating material extending along the length of the inside wall of the the drift away from the first layer of heat insulating material for reducing heat transfer to the inside wall of the drift; and joining the first and second heat insulating layers adjacent the periphery of the bulkhead to form a continuous heat seal between the inside surface of the bulkhead and the inside wall of the access drift, the continuous heat seal extending essentially entirely around the periphery of the bulkhead.

34. The method according to claim 33 wherein the first layer of heat insulating material comprises a castable refractory which is applied by spraying the castable refractory onto the surface of the bulkhead and allowing said castable refractory to cure in place on the bulkhead.

35. The method according to claim 34 including applying the second layer of heat insulating material around the drift wall prior to spraying at least a portion of the castable refractory insulation onto the inside surface of the bulkhead.

36. The method according to claim 33 including anchoring a rigid frame to the inside wall of the access drift around the periphery of the bulkhead, and sucuring the second layer of heat insulating material to the rigid frame.

37. The method according to claim 36 including spraying a layer of refractory thermal insulating material onto the drift wall to occupy a space between the rigid frame and the drift wall, and securing a portion of the second layer of heat insulating material to the frame to cover the layer of refractory insulating material.

* * * * *